US006546576B1

(12) United States Patent
Lin

(10) Patent No.: US 6,546,576 B1
(45) Date of Patent: Apr. 15, 2003

(54) STRUCTURE OF A VENTILATED MATTRESS WITH COOLING AND WARMING EFFECT

(76) Inventor: Ku-Shen Lin, P.O. Box 82-144, Taipei (TW)

( * ) Notice: Subject to any disclaimer, the term of this patent is extended or adjusted under 35 U.S.C. 154(b) by 0 days.

(21) Appl. No.: 09/985,509

(22) Filed: Nov. 5, 2001

(51) Int. Cl.[7] ..... H47C 21/04
(52) U.S. Cl. ..... 5/423; 5/726; 5/652.2
(58) Field of Search ..... 5/423, 421, 724, 5/726, 652.1, 652.2, 704, 284; 62/3.3, 3.5, 261, 237; 165/58, 59, 80.3

(56) References Cited

U.S. PATENT DOCUMENTS 460,439 A * 9/1891 Hildreth ..... 5/724
2,493,067 A * 1/1950 Goldsmith ..... 5/726
5,416,935 A * 5/1995 Nieh ..... 5/423
6,006,524 A * 12/1999 Park ..... 62/3.7
6,336,237 B1 * 1/2002 Schmid ..... 5/726

* cited by examiner

*Primary Examiner*—Heather Shackelford
*Assistant Examiner*—Frederick Conley
(74) *Attorney, Agent, or Firm*—Leong C. Lei

(57) ABSTRACT

An improved structure of a ventilated mattress with cooling and warming effect is disclosed. The structure comprises a mattress body, a warming/cooling air-delivery controlling box, and a connecting tube. The control box produces warming/cooling air to the mattress body via the connecting tube and the warming/cooling air is released via a plurality of ventilation buttons mounted at the surface of the mattress body. Thereby, the mattress provides the user with a warming/cooling effect.

2 Claims, 5 Drawing Sheets

STRUCTURE OF A VENTILATED MATTRESS WITH COOLING AND WARMING EFFECT

BACKGROUND OF THE INVENTION (a) Technical Field of the Invention

The present invention relates to a ventilated mattress, and in particular, a structure of a ventilated mattress having both cooling and warming effect.

(b) Description of the Prior Art

In the summer, conventional mattress will easily become very warm after the user slept unit for a couple of minutes. This is due to the body temperature of the user which cannot be released and discharged away from the mattress. Thus, most of the people need another fan or an air-conditioner to ease the discharging of hot/warm air to allow the hot air to circulate within the room. In the winter, an electric heater may be use so as to provide heat to the user. However, the drawbacks of this conventional mattress are that The blowing of cool air from the air conditioner or fan is not healthy and flu may be easy arisen, in particular to the elderly or the infant. Besides, the air conditioner consumes large amount of electrical energy. Secondly, heaters or electrical mattress used during the winter are mainly for the elderly, again, it is a high power consumption appliance and/or may cause electrical shock if these appliances are not properly handled. Thirdly, this type of keeping warm by using the electrical mattress is not comfortable. Therefore, it is an object of the present invention to provide an improved structure of a ventilated mattress with cooling and warming effect which mitigates the above-mentioned drawbacks.

SUMMARY OF THE INVENTION

Accordingly, it is an object of the present invention to provide an improved structure of a ventilated mattress with cooling and warming effect, wherein the mattress allows the adjusting of temperature within the mattress so as to provide a comfortable temperature to the user.

Yet another object of the present invention is to provide an improved structure of a ventilated mattress with cooling and warming effect, wherein the mattress body can either be directly mounted to the mattress box or a steel frame so as to provide an optimum combination and use to the user.

An aspect of the present invention is to provide an improved structure of a ventilated mattress with cooling and warming effect comprising a mattress body, an externally connected, cooling and warming air-delivery control box, and a connecting tube, characterized in that the surface of the mattress body is evenly mounted with a plurality of ventilation buttons having the top portion thereof being arc-shaped smooth head, and the center region thereof is a through hole, allowing air from the interior of the mattress body to release; the externally connected cooling/warming air delivery control box comprises a cooling air connector, a warming air connector, a plurality of cooling/warming exchange chip, a fragrant box, a fan, a switch and a temperature adjusting element, and the chips are mounted centrally to an empty slot of an isolated layer by a chip clipping layer, such that the two faces of the chip isolate at the isolated layer to form a warming air region and a cooling air region, and each face of the chip is provided with heat dissipation fins and condensing fins and the chip provides a warming surface at one side and a cooling surface on the other side. The controlling of the warming and cooling surface is done by the temperature adjusting device. With the combination of such controlling device together with the isolated layer of the controlling box, the controlling box can simultaneously provide a warming and cooling effect respectively released via a warming air connector or a cooling air connector, or the air is delivered at a temperature of ambient temperature, fan is mounted at the rear side of the controlling box. The fan produces air to cover the warming air region and cooling air region. In other words, a single fan is used to achieve the delivery of warming air and/or cooling air by switching selection of the warming air connector or the cooling air connector and at an appropriate position on the isolated layer, a slot for the mounting of the fragrant box at the edge portion thereof is provided, as shown in FIG. 5. Similarly, the fragrant box is positioned across the warming air region and the cooling air region, and the fragrant smell is released through the releasing holes at the edge portion of the fragrant box together with the warming air/cooling air through the mattress body. In addition, the interior of the warming air connector and the cooling air connector is provided with air filter, and the connectors are rapidly connected with the connecting tube.

Yet a further object of the present invention is to provide an improved structure of a ventilated mattress with cooling and warming effect, wherein a fragrant smell is provided to the room.

Other objects and advantages of the present invention will become more apparent from the following description taken in conjunction with the accompanying drawing.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
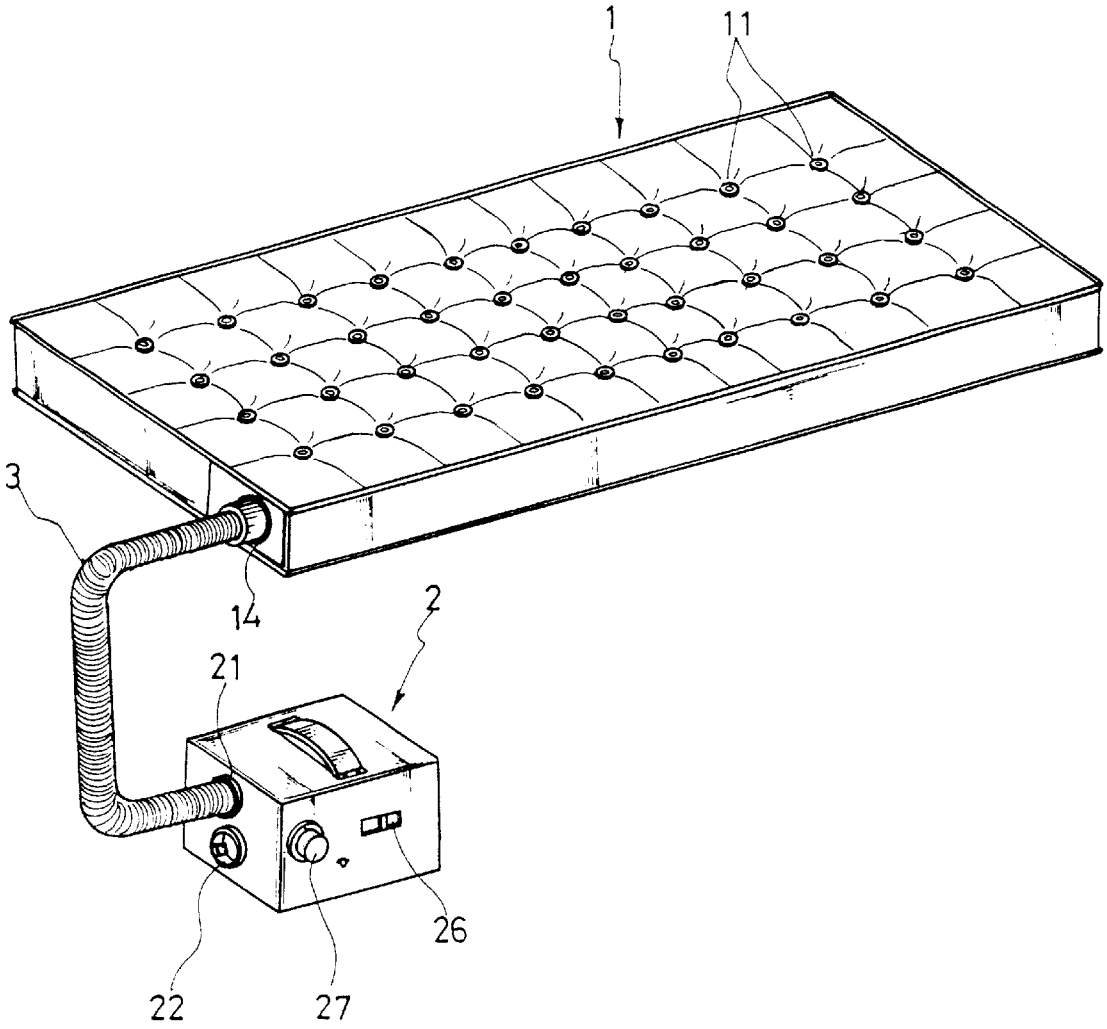
FIG. 1 is a perspective view of an improved structure of a ventilated mattress with cooling and warming effect of the present invention.
Figure 2:
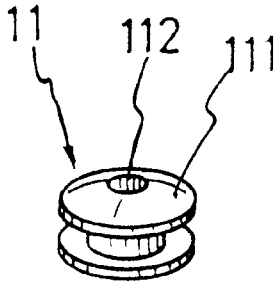
FIG. 2 is a perspective view of the ventilation button in accordance with the present invention.
Figure 3:
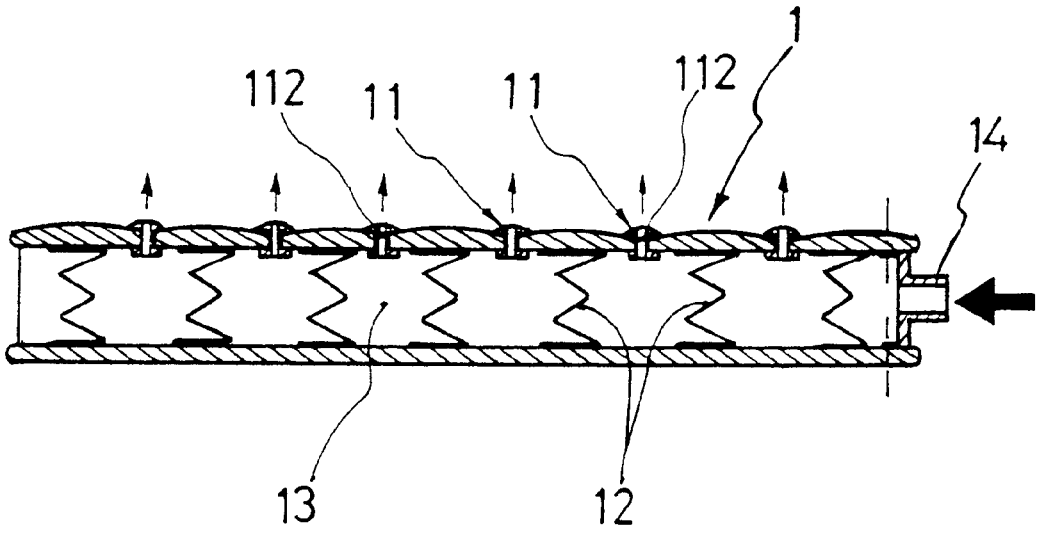
FIG. 3 is a sectional view of an improved structure of a ventilated mattress with cooling and warming effect of the present invention.

Referring to FIG. 1, there is shown an improved structure of a ventilated mattress with cooling and warming effect comprising a mattress body 1, an externally connected, cooling warming air-delivery control box 2, and a connecting tube 3. The structure can also be clearly seen in FIGS. 2, 3 and 5, wherein the surface of the mattress body 1 is evenly-mounted with a plurality of ventilation buttons 11 which are being downwardly depressed from the mattress body 1, such that the force exerted onto the mattress 1 surface will not touch the ventilation button 11. The top portion of the ventilation button 11 is a smooth arc-shaped head 111 having a center through hole 112. When air is filled to the mattress 1, the air will release from the through hole 112. As shown in FIG. 3, the mattress body 1 is a conventional structured sleeping mattress having a central region mounted with a plurality of springs 12. The central region of the mattress body 1 provides good ventilation space. Thus, the air from the connecting tube 3, passing through the mattress body connector 14 is then delivered through the ventilation button 11. As a result, the entire mattress body 1 is provided with either cooling or warming effect.

Figure 4:
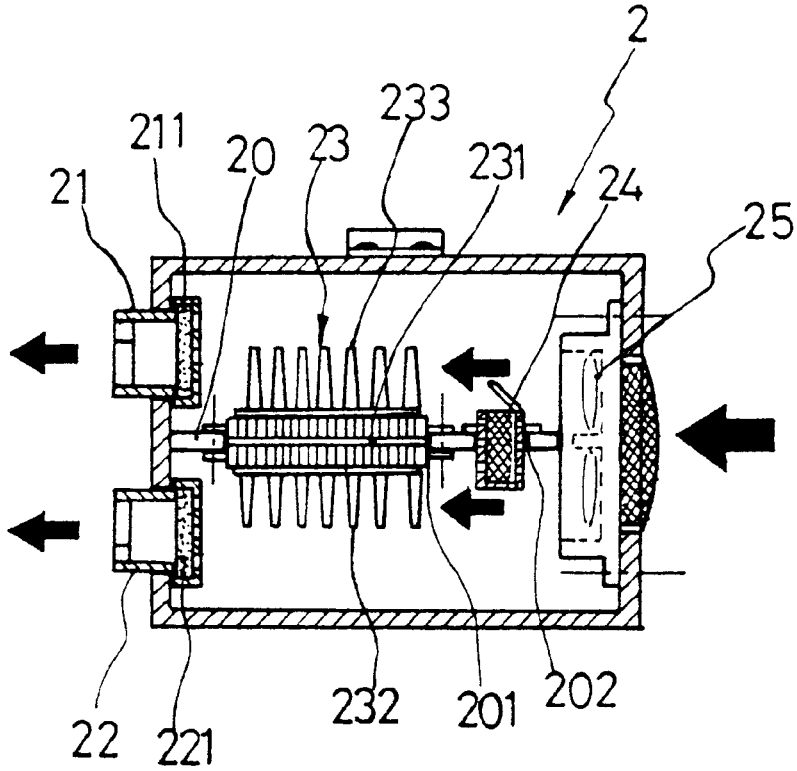
FIG. 4 is a sectional view of the air-delivery control box of the present invention.

Referring to FIG. 4, the externally connected cooling/warming air delivery control box 2 comprises a cooling air connector 21, a warming air connector 22, a plurality of cooling/warming exchange chip 23, a fragrant box 24, a fan 25, a switch 26 and a temperature adjusting element 27, and the chips 23 are mounted centrally to an empty slot 201 of an isolated layer 20 by a chip clipping layer 231, such that the two faces of the chip 23 isolate at the isolated layer 20 to form a warming air region and a cooling air region, and each face of the chip 23 is provided with heat dissipation fins 232 and condensing fins 233. In accordance with the present invention, when the electrical power of the air-delivery control box 2 is switched on, the chip 23 provides a warming surface at one side and a cooling surface on the other side. The controlling of the warming and cooling surface is done by the temperature adjusting device 27. With the combination of such controlling device 27 together with the isolated layer 20 of the controlling box 2, the controlling box 2 can simultaneously provide a warming and cooling effect respectively released via a warming air connector 22 or a cooling air connector 21, or the air is delivered at a temperature of ambient temperature.

Figure 5:
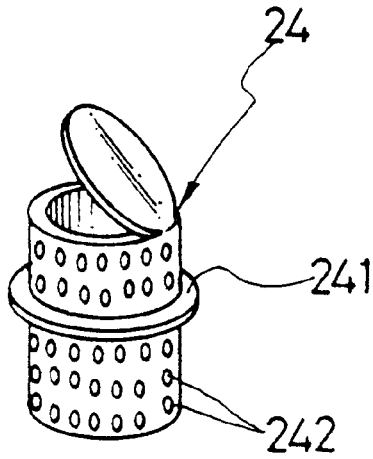
FIG. 5 is a perspective view of a fragrant box in accordance with the present invention.

As shown in FIG. 4, a fan 25 is mounted at the rear side of the controlling box 2. The fan 25 produces air to cover the warming air region and cooling air region. In other words, a single fan is used to achieve the delivery of warming air and/or cooling air by switching selection of the warming air connector 22 or the cooling air connector 21. In accordance with the present invention, at an appropriate position on the isolated layer 20, a slot 202 for the mounting of the fragrant box 24 at the edge portion 241 thereof is provided, as shown in FIG. 5. Similarly, the fragrant box 24 is positioned across the warming air region and the cooling air region, and the fragrant smell is released through the releasing holes 242 at the edge portion 241 of the fragrant box 24 together with the warming air/cooling air through the mattress body 1.

In addition, the interior of the warming air connector 21 and the cooling air connector 21 is provided with air filter 211, 221, and the connectors 21, 22 are rapidly connected with the connecting tube 3.

Figure 6:
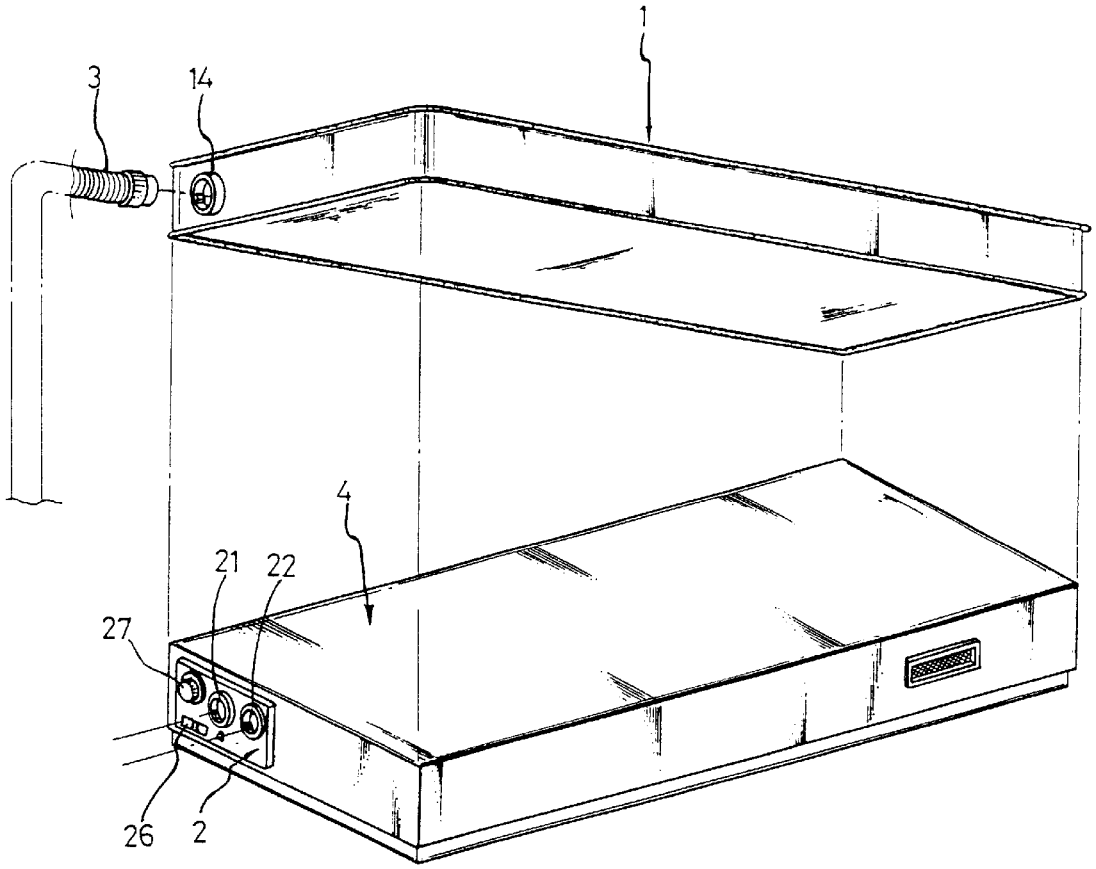
FIG. 6 is a schematic view showing the mounting of the mattress structure of the present invention.
Figure 7:
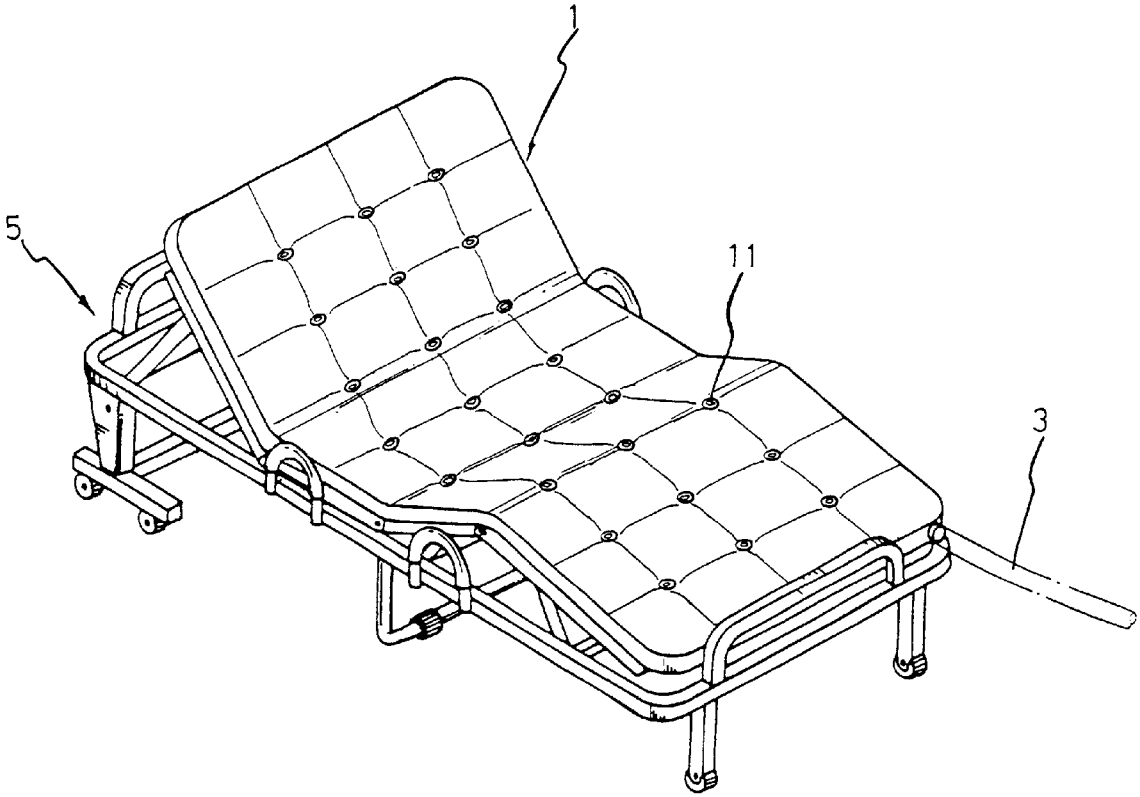
FIG. 7 is a schematic view illustrating the mattress body mounted onto a steel frame bed.

Referring to FIG. 6, there is shown the controlling box 2 being directly connected to the interior of a mattress box 4, or as shown in FIG. 7, the mattress body 1 is mounted onto a steel frame bed 5.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. An improved structure of a ventilated mattress with cooling and warming effect comprising a mattress body, an externally connected, cooling and warming air-delivery control box, and a connecting tube, characterized in that the surface of the mattress body is evenly mounted with a plurality of ventilation buttons having the top portion thereof being arc-shaped smooth head, and the center region thereof is a through hole, allowing air from the interior of the mattress body to release; the externally connected cooling/warming air delivery control box comprises a cooling air connector, a warming air connector, a plurality of cooling/warming exchange chip, a fragrant box, a fan, a switch and a temperature adjusting element, and the chips are mounted centrally to an empty slot of an isolated layer by a chip clipping layer, such that the two faces of the chip isolate at the isolated layer to form a warming air region and a cooling air region, and each face of the chip is provided with heat dissipation fins and condensing fins and the chip provides a warming surface at one side and a cooling surface on the other side.

2. The improved structure of claim 1, wherein the warming/cooling air controlling box is directly connected to the interior of a mattress box.

* * * * *